United States Patent [19]

Sugiyama et al.

[11] 4,151,777

[45] May 1, 1979

[54] PIANO SOUND PICKUP METHOD AND DEVICE

[76] Inventors: Keiichi Sugiyama, 2-12-4 Yamato-cho; Ikuo Nosaka, 2-19-7 Arai, Nakano-ku, both of Tokyo, Japan

[21] Appl. No.: 742,775

[22] Filed: Nov. 18, 1976

[30] Foreign Application Priority Data

Nov. 27, 1975 [JP] Japan ..... 50-142071
Mar. 25, 1976 [JP] Japan ..... 51-32976

[51] Int. Cl.[2] ..... G10D 5/00
[52] U.S. Cl. ..... 84/1.16; 179/1 M; 179/121 D; 179/146 R; 181/158
[58] Field of Search ..... 84/1, 1.04, 1.06, 1.14, 84/1.16, 461–463; 179/121 D, 146 R, 179, 1 DM, 1 M, 1 MF; 181/155, 158

[56] References Cited

U.S. PATENT DOCUMENTS

| | | | |
|---|---|---|---|
| 2,463,762 | 3/1949 | Giannini | 181/158 X |
| 2,515,031 | 7/1950 | Black | 181/158 X |
| 2,927,167 | 3/1960 | Michael | 84/1.16 X |
| 3,995,124 | 11/1976 | Gabr | 179/121 D X |

*Primary Examiner*—Lawrence R. Franklin
*Attorney, Agent, or Firm*—Burgess, Ryan and Wayne

[57] ABSTRACT

A method and a device for picking up sounds from a piano by a microphone placed between a wall of a piano case in opposed relation with a sounding board and a surface located in opposed relation with the sounding board of a sound-absorbing member. The sound-absorbing member consists of a planar body or a hollow body having an anechoic enclosure with bidirectivity and with both open ends cut away at angles relative to the axis of the enclosure, and the microphone is placed between the planar body and the wall or in the anechoic enclosure.

4 Claims, 14 Drawing Figures

PIANO SOUND PICKUP METHOD AND DEVICE

BACKGROUND OF THE INVENTION

The present invention relates to a method and a device for clearly picking up and recording piano sounds with a small-sized microphone.

In general, a microphone has been placed on a case of a piano or at a place suitably spaced apart from the piano in order to pick up piano sound. As compared with other musical instruments a piano is very large as an acoustic source and generates musical sounds of frequencies over a wide range having high intensity and other very complex physical properties, so that it has been extremely difficult to pick up piano sound with a single microphone. Even in a recording stage a skilled and well-experienced specialist must carefully decide a single microphone setup for picking up piano sounds so that it is almost impossible for an amateur to set up a microphone for picking up piano sounds at home. Pianos in homes are almost all of the upright type having a completely enclosed case and are placed within relatively small rooms which tend to pick up external noise. Therefore for laymen who have no special knowledge of microphone setups it is impossible to clearly and distinctly pick up piano sounds for recording.

SUMMARY OF THE INVENTION

According to the present invention, a microphone is placed in a piano case between (i) a wall thereof in opposed relation with a sounding board (ii) a surface in opposed relation with the sounding board of a sound-absorbing member.

According to one embodiment of the present invention the sound-absorbing member consists of a hollow body which is made of a sound-absorptive material and has an anechoic enclosure with open ends cut away at angles relative to the axis thereof to provide bidirectivity, and a microphone is placed within the anechoic enclosure. The sound-absorbing member is placed in the piano in such a way that the slantly cutout end openings may be directed toward the sounding board.

According to another embodiment of the present invention the sound-absorbing member consists of a substantially flat plate which is made of a sound-absorptive material, is in the form of a square or any other configuration and is disposed in parallel with a wall of a piano case in opposed relation with a sounding board and spaced apart from the wall by a suitable distance, and a microphone is placed between the sound-absorbing plate and the wall.

According to the present invention, pickup of external noise may be substantially eliminated, and musical sounds produced by a piano may be picked up and recorded distinctly and faithfully over a considerably wide frequency range with a high signal-to-noise ratio. Therefore a player may distinctly and faithfully record his playing at any time in a very simple manner with a small magnetic recorder such as a cassette recorder incorporated in a piano in such a way that it may be readily operated by the player. Thus, a player is freed from the complex microphone placement problem. When it is difficult to incorporate a recorder in a piano, the microphone may be connected through an output jack to an exterior recorder which may be placed in a convenient position for a player.

DESCRIPTION OF THE PREFERRED EMBODIMENTS

Figure 1:
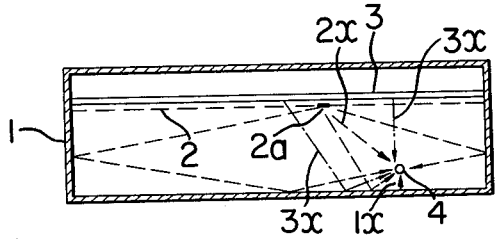
FIG. 1 is a schematic sectional view of a piano case used for the explanation of the underlying principle of the present invention.

One of the techniques for solving the above problem is to place a microphone within the case of a piano for the direct pickup of sounds from a sounding board or soundboard as will be described below with reference to FIG. 1. Within the case lower pitch strings 2 are arranged on the left side with higher pitch strings 2 on the right side. Vibrations of the strings 2 are transmitted through a bridge to the soundboard 3, which intensifies the sound, the intensified sound being picked up by a microphone 4 placed at a suitable position within the casing. In FIG. 1, 2*a* indicates the position of a string under vibration.

When the microphone 4 is placed within the case which is defined by parallel wall surfaces of hard wood boards and is substantially hermetically sealed, a single or point pickup results regardless of the directivity or directional characteristic of the microphone. At a point where the microphone 4 is placed, the sound waves (which have experienced very complex reflections within the case) are concentrated to interfere with each other and are picked up by the microphone in this state. Thus the microphone 4 cannot clearly and faithfully pick up only the sounds from the sounding board 3. More specifically, the microphone 4 picks up the sound 1*x* produced by the vibrations of the case 1, the sounds indicated by the broken-line arrows 2*x* produced by the vibrations of the string 2 and echos thereof, and the sounds indicated by the chain-line arrows 3*x* produced by the soundboard 3 and echos thereof.

A more critical problem is that standing waves tend to be formed at points where the sounds of relatively high frequencies are incident to and reflected from the inner surfaces of the case 1 at right angles thereto. When standing waves should be formed around the pickup point, faithful and clear pickup and recording of the sounds from the soundboard 3 would not be expected at all because the sound pressure and particle velocity of the standing wave are twice as high as in the case when no standing wave exists.

The present invention was made to solve the above and other problems encountered in the prior art methods and arrangements for picking up and recording sounds of a piano and has as its object to provide a method and device for picking up the sounds of a piano wherein a microphone is placed in a space defined by a wall surface of the case in opposed relation with a soundboard and a sound-absorptive member interposed between said wall surface and said soundboard in opposed relation therewith, whereby the sounds from the lowest to the highest frequency may be faithfully and clearly picked up.

Next referring to FIG. 2, the underlying principle of the present invention will be described. In contradistinction to the arrangement shown in FIG. 1, the microphone 4 is placed within a sound-absorbing member 11 supported by a supporting member 10 made of a sound insulation material. The construction of the sound-absorbing member 11 is shown in detail in FIG. 3. It is cylindrical in shape, and a diaphragm of the microphone 4 is placed intermediate of the ends and coaxially of the sound-absorbing member 11. Both ends A and B are slanted, and if required a partition wall 17 or directivity control plate may be placed in the sound-absorbing member 11 and spaced apart from the end B by a suitable distance in order to adjust the opening area of the end B side.

With the above placement of the microphone 4, various sound waves reflected by the walls of the case 1 and redirected toward the pickup point are absorbed, interrupted and removed at the outer surface of the sound-absorbing member 11. Because of its construction the cylindrical sound-absorbing member 11 serves as a so-called pressure gradient type pickup with baffle effects and has, as a whole, bidirectivity. The sound waves enter the open ends A and B which are in opposed relation with the soundboard 3, and no reflection occurs in the cylindrical, anechoic enclosure defined by the sound-absorbing member 11, so that interference hardly occurs and the microphone 4 picks up mainly the sound waves propagated directly from the soundboard 3. The sound-absorbing member 11 has a field pattern indicated by hatched area a and b in FIG. 2. The field patterns are different in front of the ends A and B because the partition plate 17 is placed on the side of the end B as shown in FIG. 3 and because the ends A and B have different slant angles. Thus the directivities on the sides of the ends A and B may be suitably selected by the position and configuration of the partition wall 17 so that the sound-absorbing member 11 may be placed more closely to the higher pitched strings (the right side in FIG. 2) than to the bass strings (the left side). This placement scheme is very advantageous in that the sound waves of low and medium frequencies which are produced more often than the high-frequency sounds may be more effectively picked up.

Figure 4A:
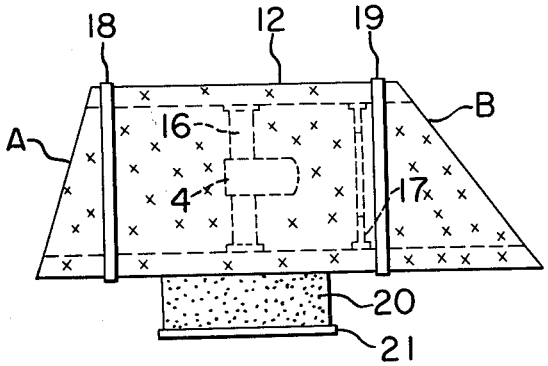
FIG. 4A is a front view of the first embodiment of a pickup assembly.
Figure 4B:
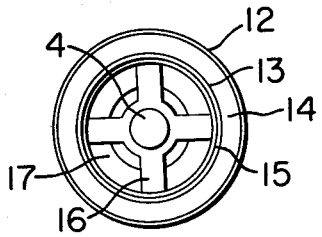
FIG. 4B is a cross sectional view thereof.

FIGS. 4(A) and 4(B) are a front view and a side view, respectively, of a preferred embodiment of a sound-absorbing member in accordance with the present invention. It comprises an outer cylinder 12 and an inner cylinder 13 disposed coaxially of and spaced apart from the outer cylinder 12 by a suitable distance. Both the outer and inner cylinders 12 and 13 are made of a perforated material or wire gauze, and a sound-absorptive material such as glass wool, rock wool, man-made fibers or the like is packed in an annular space defined between the outer and inner cylinders 12 and 13. The microphone 4 is fitted into a center hole of a cross-shaped microphone holder or hanger 16 made of a sound insulator such as a sponge elastic material and securely attached to a holding ring 15 fitted into the inner cylinder 13, so that the microphone 4 may be placed coaxially of the inner cylinder 13 and electrically connected through a cable 4*a* to an amplifier or the like not shown. Each end A or B of the pickup or outer and inner cylinder assembly is cut at such a slanting angle that a desired fundamental bidirectivity may be obtained. A center aperture 17*a* of the partition disk 17 placed within the inner cylinder 13 adjacent to the right opened end B may be suitably varied so that the opening area of the end B and hence the directivity on the high frequency side may be suitably selected. Rings 18 and 19 are fitted over the outer cylinder 12 so that the outer and inner cylinders 12 and 13 may be securely clamped together. A sound pickup assembly with the above construction is supported by a supporting member 20 made of a sound insulator such as a sponge elastic material and mounted on a mounting plate 21. In the arrangement shown in FIG. 2, the supporting member 20 and the mounting plate 21 are shown as being integrated into the supporting member 10 for simplicity.

Figure 4C:
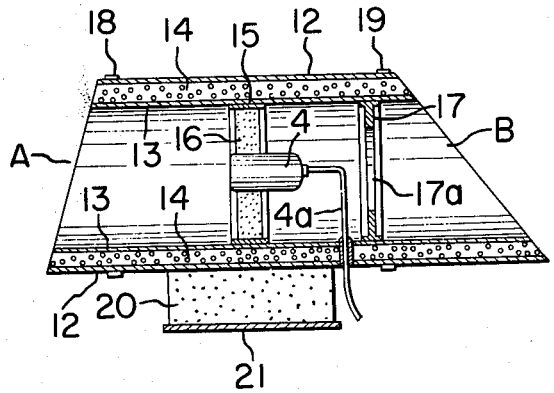
FIG. 4C is a longitudinal sectional view thereof.

The preferred embodiment described so far with reference to FIG. 4 is only one example of the present invention, and many variations and modifications may be effected as needs demand. For instance, the end portions A and B may be separated from a main body section and attached thereto in such a way that they may be swiveled and tilted to obtain a desired directivity independently of characteristics and position of a microphone used. Thus more efficient sound pickup and recording may be assured. It goes without saying that the ratio between a length and an inner diameter of the outer and inner cylinders is selected depending upon the size, characteristics and position of a microphone used. Furthermore, it is not necessary for the outer and inner cylinders to have the same diameter throughout the whole length thereof. For instance, the diameter may be progressively reduced from the low frequency side A toward the high frequency side B. Depending upon characteristics of a microphone used, the partition wall or disk 17 may be eliminated. Moreover, the sound pickup assembly may have any suitable cross sectional configurations other than a circular cross section described above.

Figure 2:
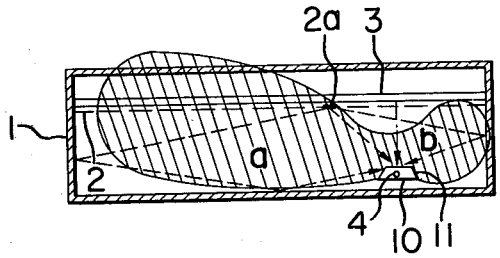
FIG. 2 is a view similar to FIG. 1 but illustrating a first embodiment of the present invention.
Figure 3A:
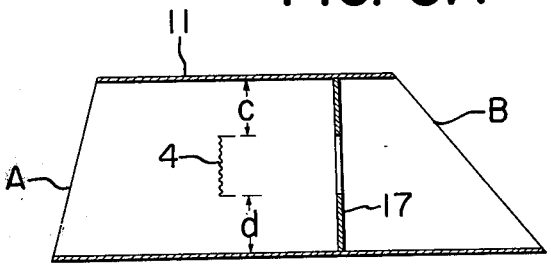
FIG. 3A is a schematic sectional view of a pickup assembly used in the first embodiment.
Figure 3B:
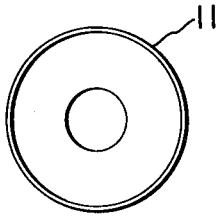
FIG. 3B is a cross sectional view thereof.

When another pickup assembly with a directivity opposite to that shown in FIG. 2 is employed, stereophonic pickup and recording may be effected.

Figure 5:
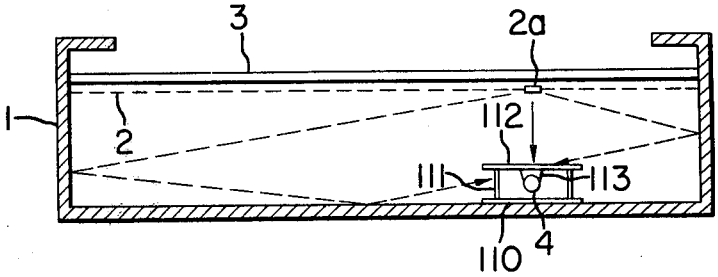
FIGS. 5 and 6 are views used for the explanation of a second embodiment of a piano pickup method.
Figure 6:
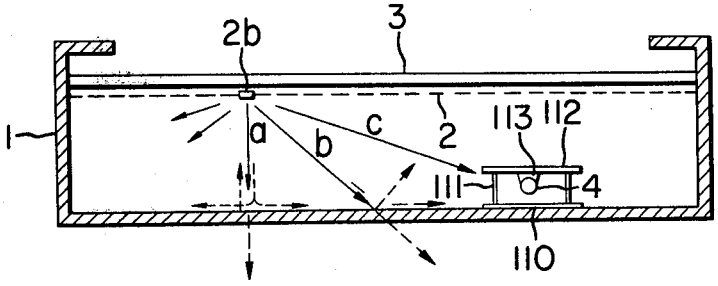

In the embodiment shown in FIGS. 5 and 6, a sound-absorbing member 110 is attached to the wall of the case 1 in opposed relation with the soundboard 3, and a plate 112 having both major surfaces lined with a sound-absorptive material is supported on the member 110 by fine columns 111 having a very small sectional area. The microphone 4 is suspended from the plate 112 by a microphone hanger 113.

The sound-absorbing plate 112 may absorb and shield the sound waves which are reflected by the walls of the case 1 and redirected toward the pickup point so that complex interferences among sound waves may be prevented. The sound waves which are propagated from the soundboard 3 directly and perpendicularly toward the wall of the case in opposed relation with the sounding board 3 may be absorbed and shielded by the sound-absorbing plate 12 as indicated by the solid-line arrow in FIG. 5 so that there are no reflected waves which interfere with each other and there are no standing waves around the microphone 4. Therefore the microphone 4 may pick up and sound waves propagated mainly from the soundboard 3 toward the microphone 4 substantially at same angles. The sound-absorbing member 110 may be eliminated if required.

Advantages of this embodiment will be further described with particular reference to FIG. 6. Sound waves which are produced by the vibrations of the string 2*b*and intensified by the soundboard 3 are propagated generally into three directions a, b and c. The sound waves which are propagated in the direction a are incident on the wall of the case 1 at right angles. The sound waves which are propagated in the direction b are incident at an angle to the wall and reflected. Some reflected sound waves are propagated in the direction indicated by the broken-line arrow while some reflected sound waves are transmitted through the case 1. some sound waves are refracted and propagated along the wall as indicated by the broken-line arrow toward the microphone 4. Thus the microphone 4 picks up not only the refracted sound waves indicated by the broken-line arrows but also the sound waves propagated in the direction indicated by the arrow c, directly striking the microphone 4. Therefore because of the existence of the sound-absorbing plate 112, faithful and clear pickup and recording may be assured.

Figure 7:
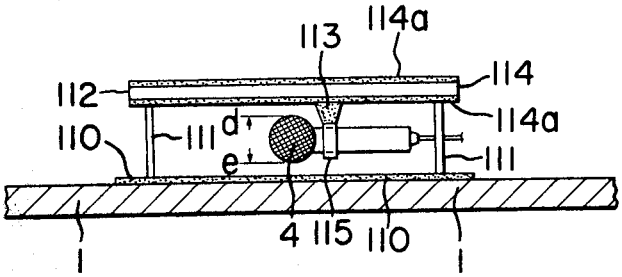
FIG. 7 is a front view of a pickup assembly used in the second embodiment.

In the embodiment shown in FIG. 7, the sound-absorbing plate 112 consists of a plate of any suitable configuration and made of wood, plywood, synthetic resin, metal or the like and lined on both major surfaces with a sound-absorptive material 114*a* such as felt, glass wool, rock wool, synthetic fibers or the like. The microphone 4 is mounted by a microphone mounting ring 115 which is rotatably mounted on the microphone hanger 113 made of a sound insulator and attached to the inner surface intermediate at the ends of the sound-absorbing plate 112. The sound-absorbing plate 112 is supported by the pillars 111 on the sound-absorbing member 110 which is slightly larger in area than the sound-absorbing plate 112. The height of the pillars 111 is so selected that the front end of the microphone 4 may be spaced apart from the two sound-absorbing members 112 and 110 by suitable distances d and e, respectively.

The embodiment shown in FIG. 7 is also a mere example of the present invention, and many variations and modifications may be effected as will be described below with reference to FIGS. 8 to 11.

Figure 8:
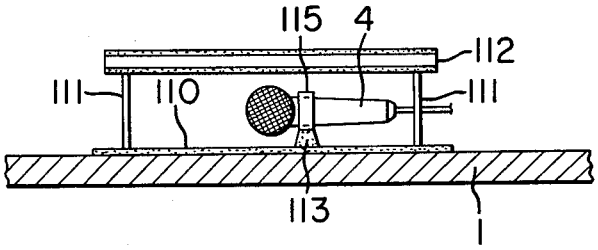
FIGS. 8, 9, 10 and 11 are views of modifications, respectively, of the pickup assembly shown in FIG. 7.

More specifically, in the modification shown in FIG. 8, the microphone hanger 113 is attached to the sound-absorbing member 110 which in turn is attached to the wall in opposed relation with the soundboard. Same features and advantages with those of the embodiment shown in FIG. 7 may be also ensured.

Figure 9:
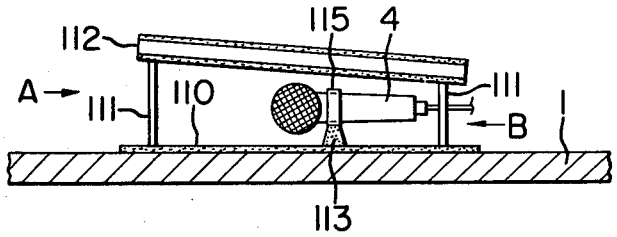

In the modification shown in FIG. 9, the heights of the pillars 111 are so selected that the sound-absorbing plate 112 may be inclined toward the wall of a piano at a suitable slope from the low frequency side A toward the high frequency side B. Therefore pickup in a desired direction may be improved or enhanced so that a directional characteristic may be varied and consequently qualities of sound to be picked up may be improved.

Figure 10:
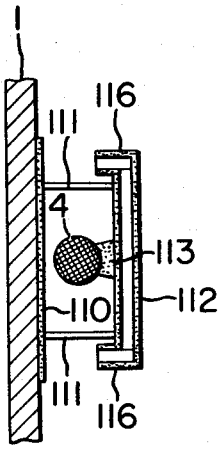

The modification shown in FIG. 10 may be advantageously employed when an installation space cannot afford the sound-absorbing plate 112 having a relatively large area. A side plate or web 116 which is also acoustically treated is attached to and extended partly or over the whole length of each side of the sound-absorbing plate 112 so that an assembly consisting of the sound-absorbing plate 112 and the side plates or webs 116 may have an I-shaped or inverted-U-shaped cross sectional configuration.

Figure 11:
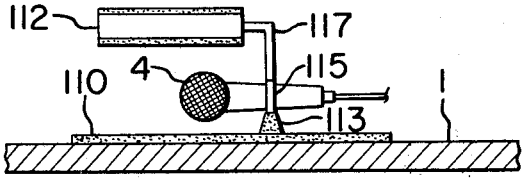

So far the sound-absorbing plate 112 has been described as being supported by the pillars 111 as shown in FIGS. 7 through 10, but as shown in FIG. 11 the pillars may be eliminated when the microphone 4 may be directly mounted on the sound-absorbing member 112. More specifically, the modification shown in FIG. 11 is substantially similar in construction to that shown in FIG. 9 except that the sound-absorbing plate 112 is supported by an angle 117 which in turn is supported by the microphone mounting ring 115.

Referring back to FIGS. 5 and 6, the lower strings are located on the left side while the higher strings are on the right side. The pickup assembly consisting of the sound-absorbing members 110 and 112, the pillars 111, the microphone 4 and the microphone hanger 113 must be installed in a very limited space within the case 1 and at a position very close to the sounding board 3 and the higher strings. As a result, a ratio of a distance from the microphone to the leftmost string 2*b* to a distance from the microphone 4 to the string 2*a* immediately above becomes considerably large. Therefore the configuration of the sound-absorbing plate 112 must be so selected that the sound waves propagated from the strings adjacent to the pickup assembly may be suitably controlled. Alternatively or simultaneously characteristics of a microphone to be used may be suitably selected. However, it is far advantageous to select a suitable configuration of the sound-absorbing plate 112 than to select a microphone with desired characteristics. Therefore, the sound-absorbing plate 112 may have any suitable configuration such as a disk, triangle or square. According to the results of experiments conducted by the inventor for finding optimum configurations of the sound-absorbing plate depending upon the pickup position or the distance from a source of sound and the frequencies of incident sound waves, it may be in the form of a cardioid, dumbbell, trapezoid or combinations thereof. In order to improve the sound-absorbing characteristic of the plate 112, the thickness thereof may be increased at the center portion than at the end portions on either or both of the major surfaces.

In summary, the most imortant feature of the present invention resides in the fact that any commercially available microphone may be used without any modification. In case of an ominidirectional microphone, it may be directed in any direction, and in case of a bidirectional microphone, it may be so oriented that the front may be directed toward the lower strings and the rear toward the high strings or vice versa. A unidirectional microphone may be so placed that its front may be directed toward the lower strings when it is placed at the rightmost side of the case. When installed in other positions, it may be so directed that its axis is parallel with the diagonal of the sounding board and is inclined slightly upwardly or downwardly in FIGS. 7 to 11.

What is claimed is:

1. An arrangement for picking up sounds from a piano case having a sounding board and a wall parallel to said sounding board, comprising:

a microphone;

a first hollow cylindrical sound-absorbing member with open ends disposed within said case adjacent said wall and extending in a direction parallel to said wall;

sound-absorbing means between said first member and said wall and parallel to said wall;

means for supporting said first sound-absorbing member from said sound-absorbing means; and sound-absorbing suspension means comprising a second cylindrical member for suspending said microphone within said first sound-absorbing member.

2. The arrangement according to claim 1, wherein said first member comprises perforated coaxial inner and outer cylinders with a sound-absorbing material therebetween.

3. The arrangement according to claim 2, wherein said first member includes a transverse partition disk having a central aperture therein.

4. An arrangement for picking up sounds from a piano case having a sounding board and a wall parallel to said sounding board, comprising:

an outer perforated hollow cylinder;

an inner perforated hollow cylinder coaxial with said outer cylinder;

a sound-absorbing material disposed between said cylinders;

a transverse sound-isolating member disposed within said inner cylinder;

a microphone disposed within said inner cylinder and supported by said transverse member;

an aperture transverse partition disk disposed within said inner cylinder in juxtaposition with said transverse member; and a sound-isolating supporting member for securing said outer cylinder to said wall with the longitudinal axis of said cylinders substantially parallel to said wall, said cylinders having open ends, with at least one of said ends defining an end surface oriented at an oblique angle with respect to said longitudinal axis.

* * * * *

UNITED STATES PATENT OFFICE
CERTIFICATE OF CORRECTION

Patent No. 4,151,777 Dated May 1, 1979

Inventor(s) Keiichi Sugiyama, et al

It is certified that error appears in the above-identified patent and that said Letters Patent are hereby corrected as shown below:

Column 5, line 4: "2band" should be --2b and--.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*